US006167617B1

(12) United States Patent
Oros et al.

(10) Patent No.: US 6,167,617 B1
(45) Date of Patent: Jan. 2, 2001

(54) METHOD OF BLIND CONNECTING AN I/O MODULE INTO A CABINET

(75) Inventors: Donald L. Oros, GatesMills, OH (US); Arthur Rousmaniere, Andover, MA (US)

(73) Assignee: Elsag International N.V. (NL)

( * ) Notice: Under 35 U.S.C. 154(b), the term of this patent shall be extended for 0 days.

(21) Appl. No.: 09/409,108

(22) Filed: Sep. 30, 1999

Related U.S. Application Data

(62) Division of application No. 08/924,353, filed on Sep. 5, 1997.
(60) Provisional application No. 60/028,237, filed on Oct. 7, 1996.

(51) Int. Cl.[7] ..... H01R 43/04
(52) U.S. Cl. ..... 29/881; 29/874; 29/876

(58) Field of Search ..... 29/874, 883, 884, 29/887, 861, 857, 876

(56) References Cited

U.S. PATENT DOCUMENTS 5,365,658 * 11/1994 Freeman et al. .
5,396,573 * 3/1995 Ecker et al. .
5,406,702 * 4/1995 Shimirak et al. ..... 29/883

* cited by examiner

*Primary Examiner*—Carl J. Arbes
(74) *Attorney, Agent, or Firm*—Vytas R. Matas

(57) ABSTRACT

A unique electrical connector for power and signal connections from an I/O cabinet of a control system to a block I/O assembly mounted in the cabinet to allow a blind fit of power and signal connection of power and signal connections insuring that power will be provided to the block I/O assembly before any application of signals thereto.

6 Claims, 6 Drawing Sheets

METHOD OF BLIND CONNECTING AN I/O MODULE INTO A CABINET

CROSS-REFERENCE TO RELATED APPLICATIONS

This application is a Division of Ser. No. 08/924,353 filed Sep. 5, 1997 also application is based on Provisional Application Serial No. 60/028,237 Filed Oct. 7, 1996 entitled ELECTRICAL CONNECTOR FOR AN I/O MODULE

BACKGROUND OF THE INVENTION

1. Field of the Invention

The present invention relates generally to modular I/O electrical assemblies and more particularly to methods and devices for connecting a I/O block to a cabinet containing a plurality of such blocks to provide a blind fit and a sequential connection of the power and signal inputs to the I/O blocks.

2. Description of the Prior Art

The prior art I/O block assemblies depended upon markings on the assemblies to insure a proper assembly of the I/O unit to its matching signal and power source in the block cabinet without regard to any sequential connection of such power and signal inputs. This failure to use proper sequence of signal and power connections caused some units to be damaged when they were connected in an improper sequence. Further, these connections were blind in some I/O modules making this sequencing a matter of guesswork. These blind connections were sometimes impossible when there was nonalignment of the I/O module and the power and signal connectors caused by tolerance buildup during the assembly of the case.

Prior art devices are known which have separate power and control connections and which teach sequential signal connection. Examples of such are found in U.S. Pat. Nos. 4,579,406 and 4,990,099 issued to Laursen and Marin et. Al. Respectively. However, none teach a blind mating connection of such sequenced power and signal connections to an I/O module in the proper power and signal sequence.

Thus a device and method was required which would prevent the application of signal inputs before power was connected as well as providing such a sequential connection using a blind fit into an I/O module. Further, this blind fit must be compensated for tolerance buildup in the assembly of the I/O block assembly.

BRIEF SUMMARY OF THE INVENTION

The present invention solves the problems associated with prior art devices and others by providing a uniquely designed electrical stepped connector for power and signal connections which elevates the power connections above the signal connections to insure that power is first connected to the block I/O unit before any signal connections are made. Also, the connector is made to be loosely fitted in the cabinet wall by snapping in the connector to a wall therein with flexible detent ends fitting into an enlarged opening in the cabinet wall. Two alignment holes are provided along the sides of the connector to allow a smaller diameter alignment pin located on the block I/O to fit into these holes to thus provide a gross alignment of the electrical connector to the block I/O base. The I/O module has stepped power and signal connectors which then mate with the electrical connector power and signal sources whenever the block I/O is properly joined to the electrical connector. The loose fit of the electrical connector in the cabinet wall allows any slight misalignment due to tolerance buildup to be compensated for when the individual units are mated.

In view of the foregoing it will be seen that one aspect of the present invention is to provide an electrical connector which allows the blind mating of a block I/O unit to a cabinet having power and signal connections for the I/O unit.

Another aspect of the present invention is to provide an electrical connector which allows the block I/O unit to be connected to a cabinet insuring proper sequencing of power and signal connections.

Yet another aspect of the present invention is to provide a loose fitting electrical connector in a cabinet which allows the block I/O unit to be blind connected in the cabinet even with tolerance buildups shifting the location of the electrical connector.

These and other aspects of the present invention will be more fully understood after a review of the following description of the preferred embodiment when considered with the accompanying drawings.

DETAILED DESCRIPTION OF THE PREFERRED EMBODIMENT

Figure 1:
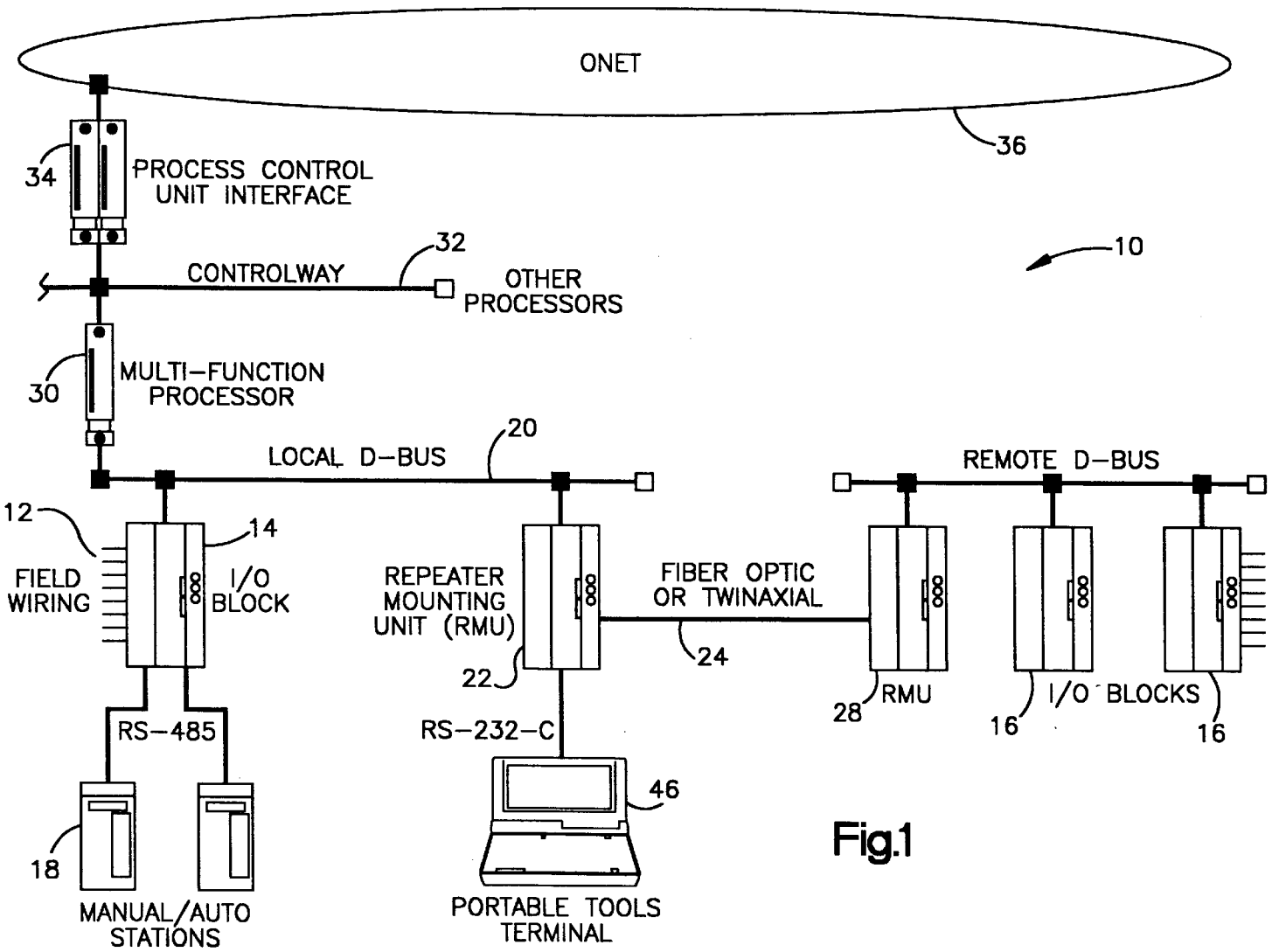
FIG. 1. is a schematic of a distributed process control system using the block I/O system cabinetry of the present invention.

Referring now to the drawings where the showings are intended to describe the preferred embodiment of the invention and not to limit it thereto, FIG. 1 shows a distributed process control system 10. Process signals are inputted along field wiring lines 12 to a series of local and remote I/O (input output)blocks 14, 16. Any of these blocks could be connected to manual/auto stations 18 for allowing operator control of the signals. Since the local D-bus (data bus)20 is relatively short (around 50 meters) a repeater mounting unit 22 (RMU) is connected to the local I/O block for conditioning the signal so it may be transmitted by either fiber optic or twinaxial cable 24 to a remotely located D-bus 26 by way of a second RMU 28 for reconditioning the signal transmitted by the first RMU so it is readable by the I/O blocks 16 connected to the remote D-bus.

The various process control signals collected along the local and remote D-bus 20, 26 are connected to a multi function control processor 30. Other processors may be also, connected to these D-buses and their control signals along with that of the processor 30 connected to a control way 32 which sends the signals to a process control unit 34 for conditioning these signals for use by a control room process unit such as the Elsag Bailey SYMPHONY process control system 36.

Figure 2:
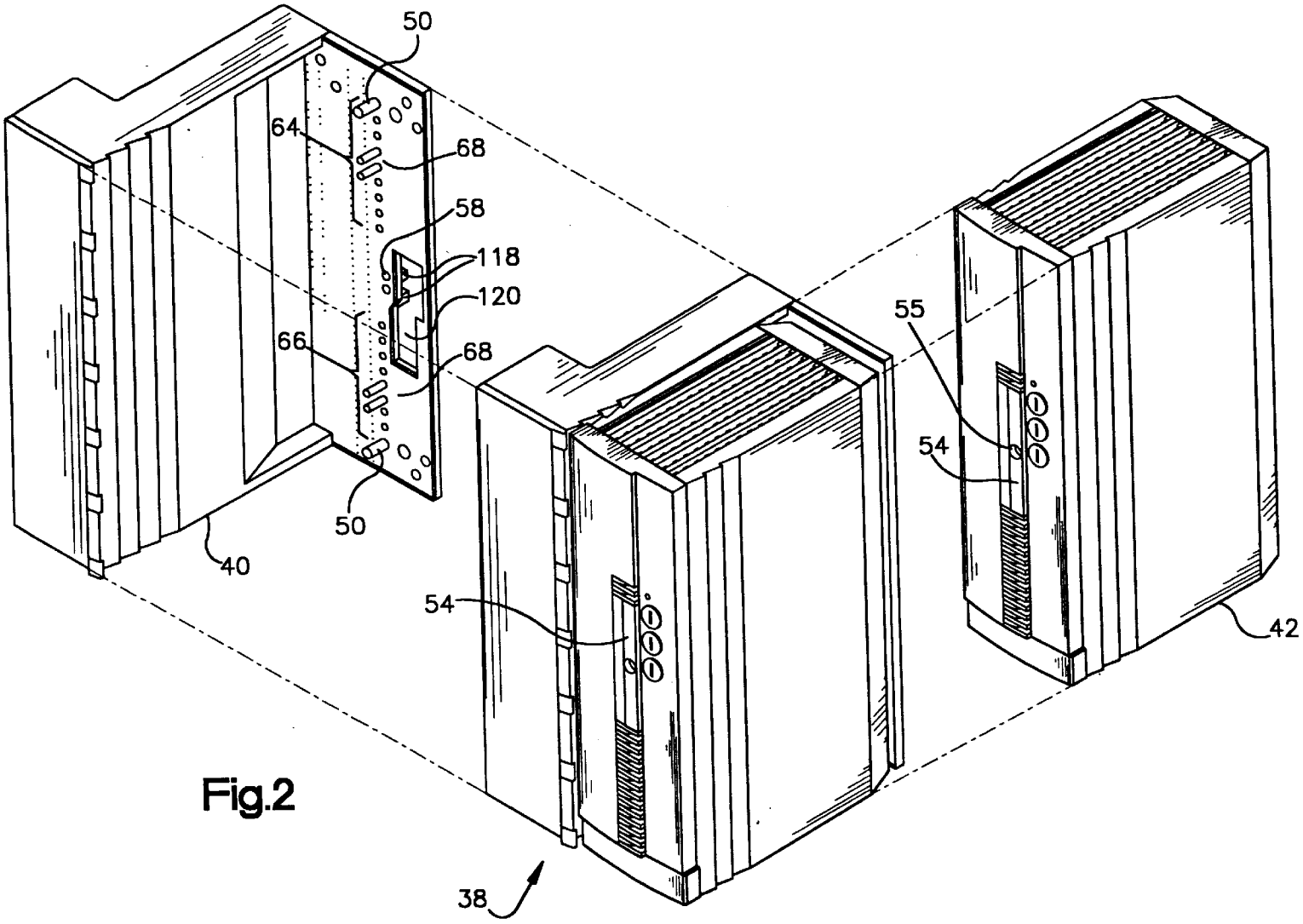
FIG. 2. depicts a block I/O assembly and the connector base and I/O module comprising same.
Figure 5:
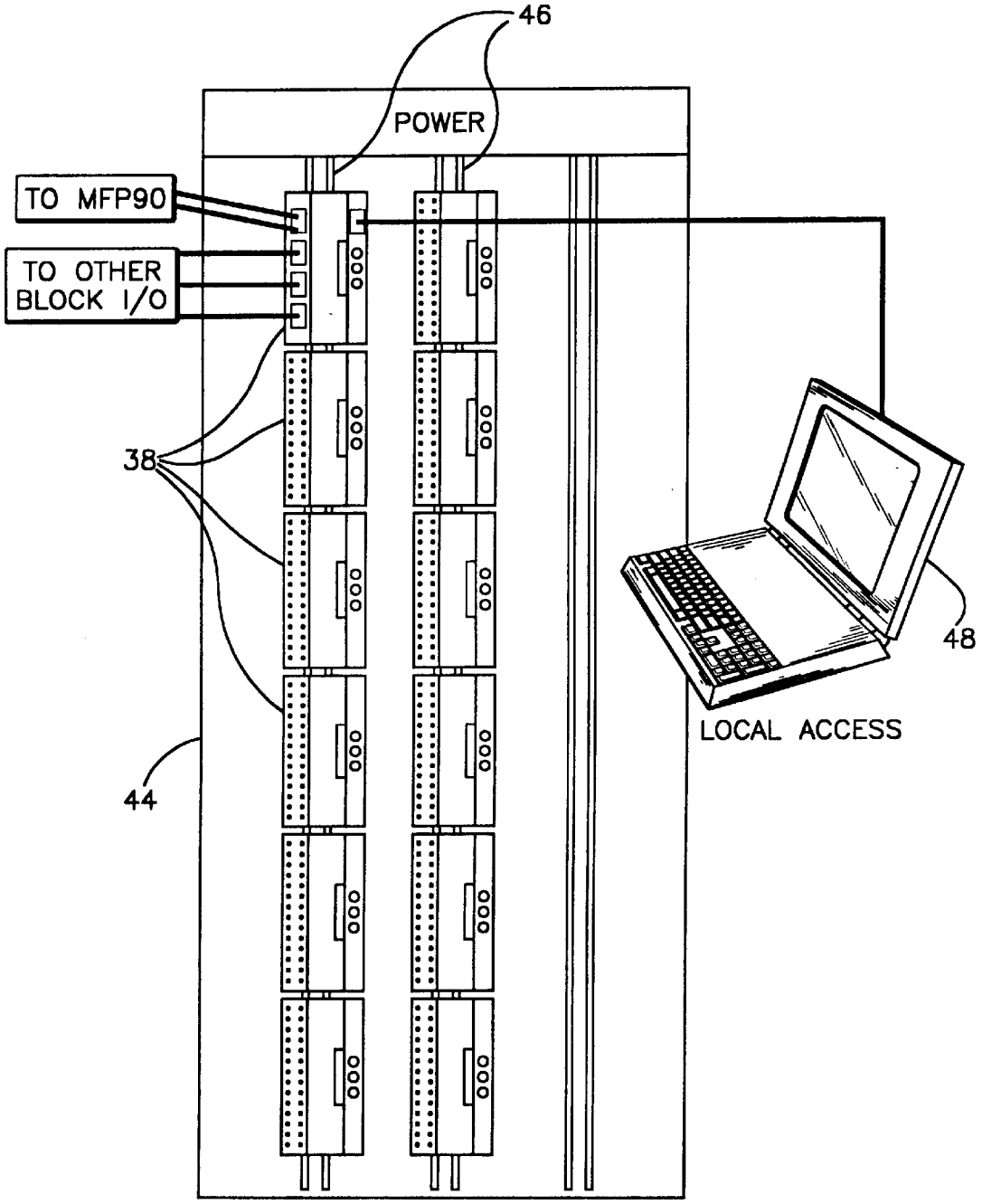
FIG. 5. is a front of a control cabinet having a plurality of I/O module assemblies connected therein.
Figure 6:
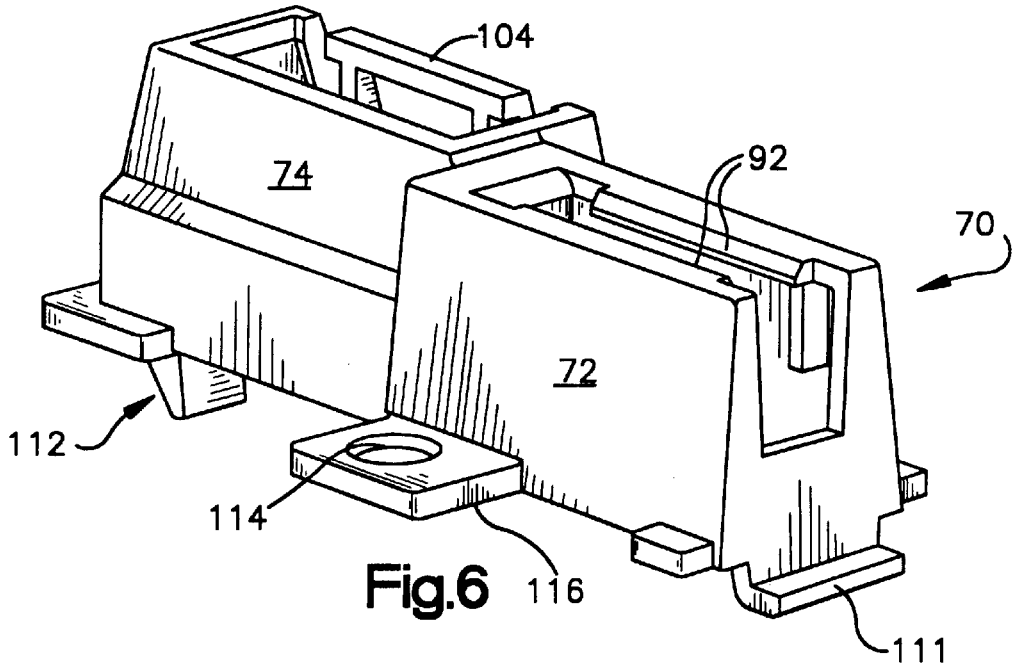
FIG. 6. is a perspective top view of the electrical connector of the present invention having power and signal connecting holders therein.
Figure 7:
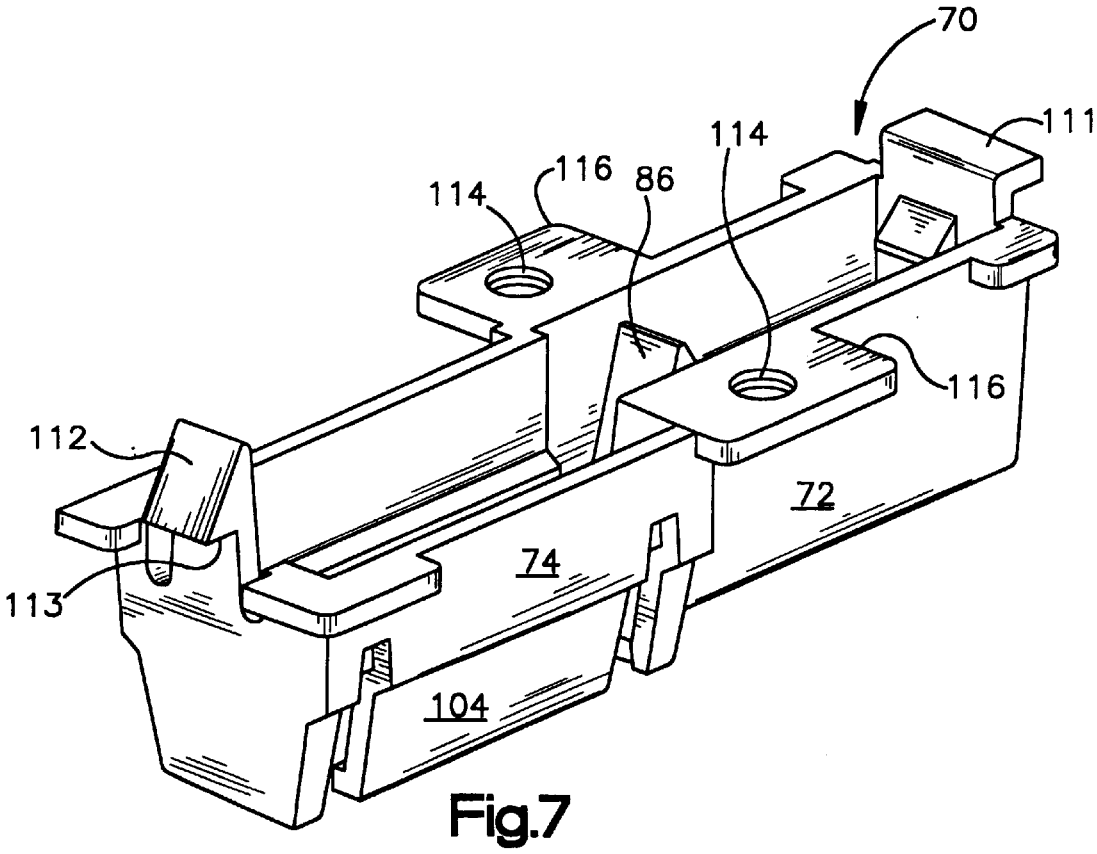
FIG. 7. is a perspective bottom view of the power and signal connecting holders of the FIG. 6 assembly.
Figure 8:
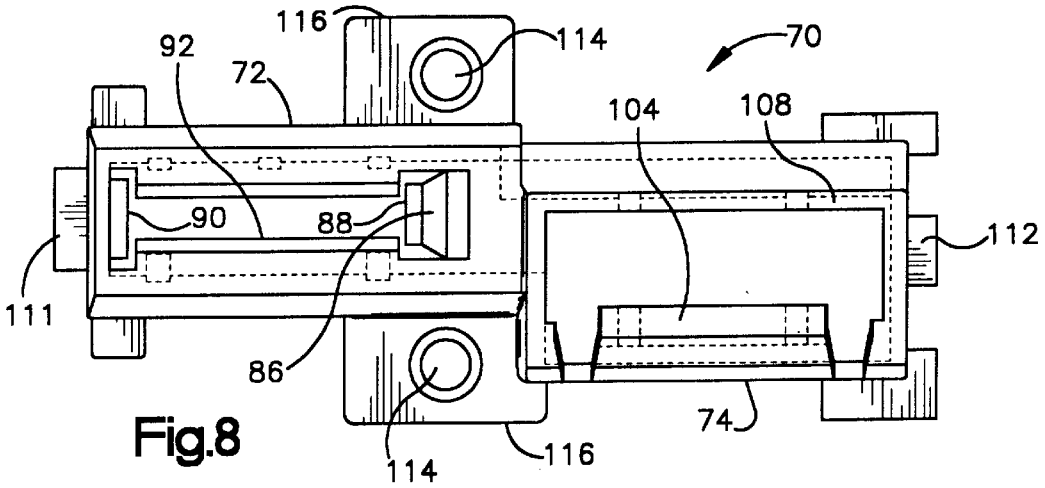
FIG. 8. is a is a top view of the connector shown in FIGS. 6 and 7.
Figure 9:
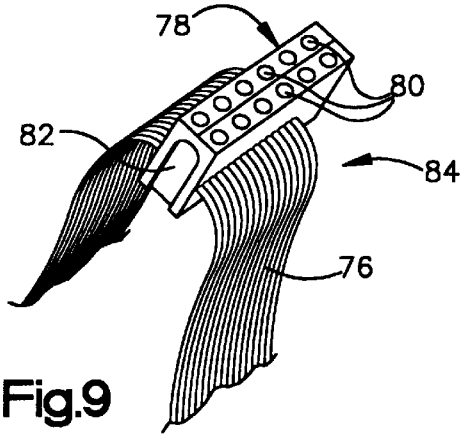
FIG. 9. is a perspective view of a ribbon signal connector which fits into the holder shown in FIGS. 6–8.
Figure 10:
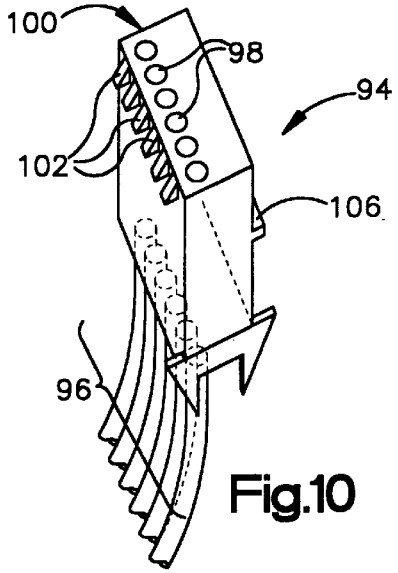
FIG. 10. is a perspective view of a power connector which fits into the holder shown in FIGS. 6–8.

As is shown in FIG. 2, the basic I/O block 38 is made up of a terminal or connector base 40 and a I/O module 42. Each block is specifically programmed or configured for a specific function and is mounted into a cabinet 44 best seen in FIG. 5. The individual block I/O's are connected to communicate with each other as well as providing local access through laptop computers 48. As best seen in FIG. 5, the connector base 40 is mounted in a known manner such as by screws or clips to a conductive column 46 found in the cabinet 44 which provides power to the I/O blocks 38 as well as communication therebetween. The I/O module is then connected to the base 40 by pushing it onto guide pins 50 found on the base 40 which fit into appropriately aligned apertures 52 on the back of the I/O module 42. The module 42 is then locked to the base 40 by pushing handle 54 to extend and lock the mechanism 56 into the base aperture 58 by tightening a screw 55 located in the center of the handle 54.

Each individual I/O block 38 is programmed for a specific function and it is imperative to make sure that the proper module 42 is inserted into the proper base. To insure this ability the base and module are specifically configured to prevent the mating of a module with other than its properly connected base.

Figure 3:
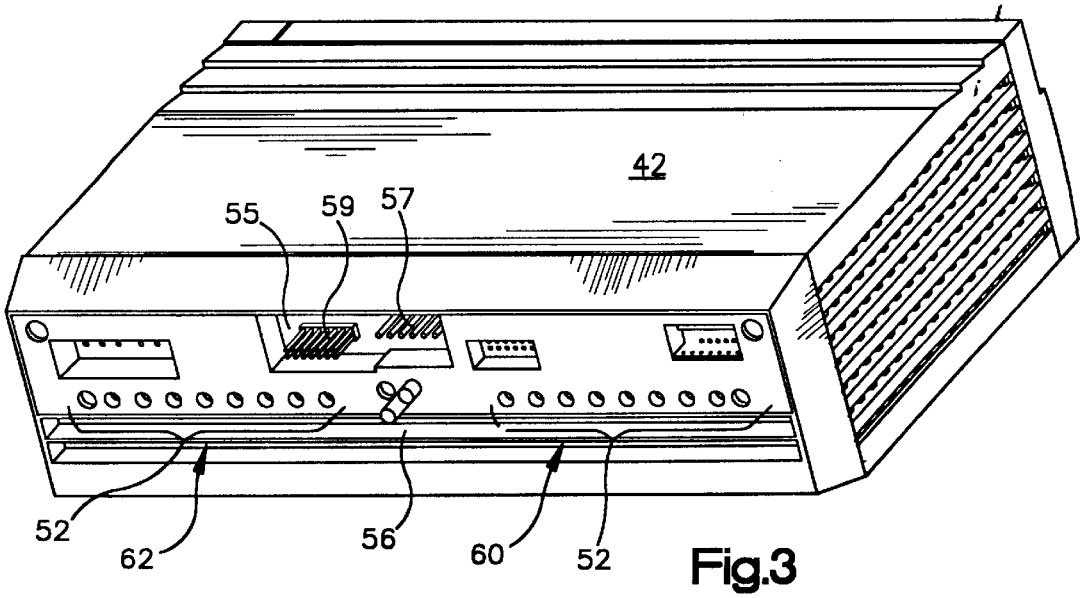
FIG. 3. is a rear view of the I/O module showing the general pattern of holes found therein for orienting plugs therein according to an identifying pattern.
Figure 4:
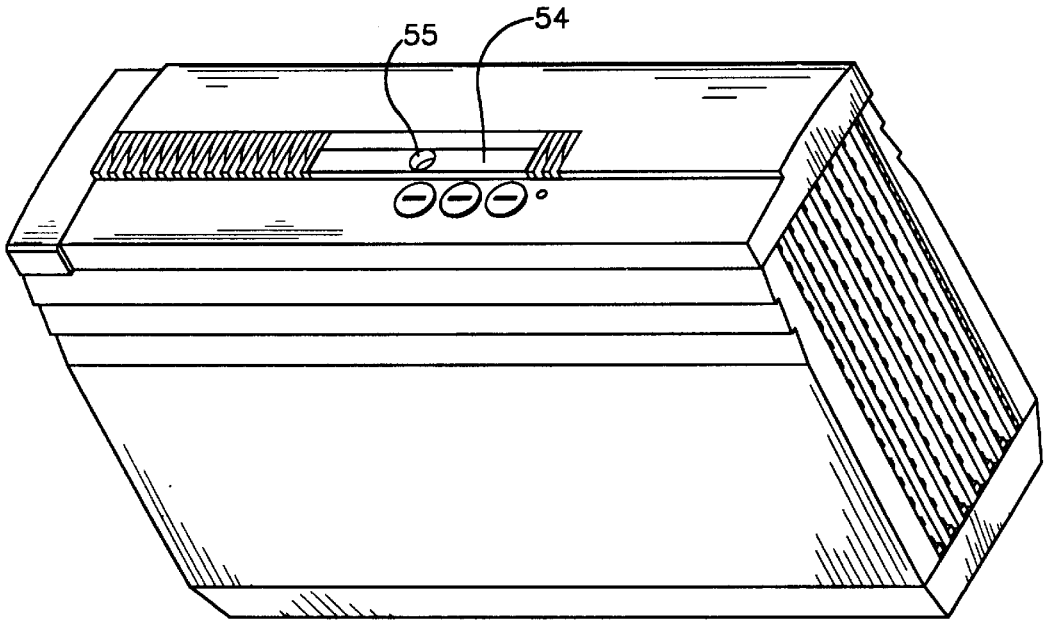
FIG. 4. is a front view of the I/O module.

As best seen in FIGS. 3–4, this is accomplished by either upper and lower holes 60,62 on the back of the module 42 which are alignable through the pegs 50 on the base 40 with complimentary eight upper and lower holes 64, 66 on the base 40 matching pins or pegs 68.

There are presently 12 different I/O modules being used. The existing I/O block are identified by the following code:

I=Input

O=Output

D=Digital

A=Analog

C=Control

These codes are combined into various combinations. You would then read these combinations as analog output for AO, analog input for AI, control input-output for CI–O, digital input-output for DI–O, digital output for DO and digital input for DI.

Figure 11:
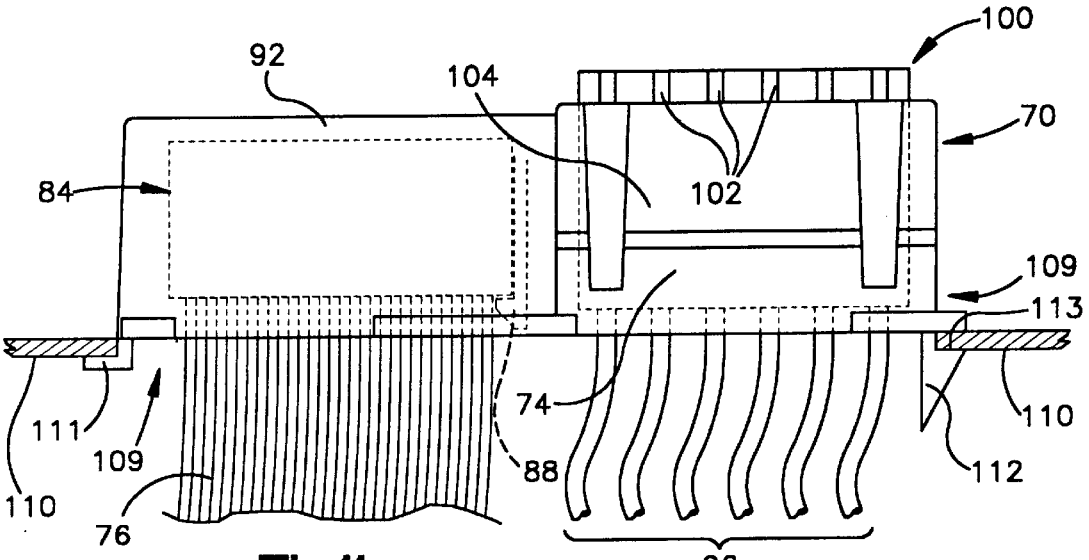
FIG. 11. is a side view of the electrical connector of the present invention shown having the power and signal connectors fitted therein shown mounted in a cabinet wall allowing alignment pins on the block I/O connector base to grossly align the holder for mating with the I/O block.

As best seen in FIGS. 5 and 11, the conductive column 46 has the connectors of the present invention mounted into openings formed on a connector wall 110 of the cabinet 44 which provide power and signal connections respectively from the cabinet 44 to the I/O module 42 of the block I/O 38. A pair of alignment pins 50 are found on the back of the I/O base or connector unit 40. When the unit 40 is mounted in the cabinet 44 the alignment pins 50 align the I/O unit through an opening 52 formed therein. This opening 52 matches an opening 55 found on the back of the I/O module 42 which has individual clustered power and signal pins 57, 59 which mate with an appropriate power and signal connections as will be explained later. The power pins 57 on the I/O module 42 will be electrically connected to the cabinet 44 before any signal pins 59 are connected to the cabinet by the proper mounting of the module 42 to the connector 40 into the I/O block assembly 38.

To provide a blind fit electrical connection of the I/O module which will also provide a sequential connection of the power signals 57 to the module before any signal 59 inputs thereto, a unique power and signal holder assembly 70 is used to mount the I/O block to the power and signal sources 46 in the cabinet 44.

As seen in FIGS. 6–11, the holder assembly 70 is made from polycarbonate material to have a lower signal 59 cable holding area 72 and a power 57 holding area 74 elevated from the signal area 72.

A signal 59 ribbon connector 76 is connected to a end cap 78 which provides electrical conduction from the individual ribbon 76 signal lines to a plurality of electrical connecting openings 80 in a well known manner. The cap 78 has a detented section 82 on both ends. This signal assembly 84 is mounted into the holder 70 signal section 72 by pressing back a flexible inner wall 86 having a hooked section 88 to allow the detent 82 to slide along a matching protrusion wall 90 inside the section 72 until the hook section 88 snaps back across the bottom of the cap 78 holding the signal assembly firmly therein. Wall sections 92 extends over the cap 78 in the signal area 74 to effectively capture the signal assembly between these wall sections 92 and the hooked area 88.

A power signal assembly 94 has six electrical lead wires 96 individually connected to six electrical apertures 98 formed in a cap assembly 100 to provide electrical conduction from the wires 96 to the apertures 98 in a known manner. The assembly 100 also has a series of extending tips 102. The power assembly 94 is fitted into the section 74 of the holder 70 by pushing the top of the assembly 94 into the section 74 against the flexible wall section 104 until the sections or teeth 102 lock on the top of wall 104. A rib 106 formed on the back of the assembly 94 then rests against a wall 108 formed in the holder 70 to prevent any further upward movement of the assembly 94 in the area 72.

As best seen in FIG. 11 the holder is mounted into an enlarged opening area 109 formed on a connector wall 110 of the cabinet 44 which provides power and signal connections from the cabinet 44 to the ribbon connectors 76 and the power wires 96. The holder 70 is mounted to this area by tilting an extended rigid ear section 111 formed on one end of the holder 70 into the opening 109 to extend under the wall section 110 and then snapping a flexible ear sections 112 formed on the end of the holder opposite the ear section 111 through the opening 109 to catch under the wall section 110. The opening 109 is slightly wider than the connector 70 providing a loose sideways fit. Also, the flexible member 112 by virtue of its flexibility and the width of the extended tip 113 allows lateral movement of the assembly 70 in the opening 109 to thus provide a blind fit of the I/O module which will compensate for tolerance buildup during assembly of the component parts.

The holder 70, also has a pair of enlarged openings 114 formed through wing sections 116 located along the section 72 of the holder 70. These openings act as alignment holes for a pair of alignment pins 118 found on the back of the I/O base or connector unit 40. When the unit 40 is mounted to the wall 110 of the cabinet 44 the alignment pins being smaller than the opening 114 will grossly align the holder 70 to be oriented with an opening 120 formed therein. This opening matches an opening 122 found on the back of the I/O module 42 which has individually clustered power and signal pins 124, 126 which mate with the holes 98, 80 found on the cap assemblies 84, 94. Since the power assembly 94 is maintained higher than the signal assembly 84 when both are mounted in the holder 70, the power pins 124 on the I/O module 42 will be electrically connected to the cabinet before any signal pins 126 are connected to the cabinet by the proper mounting of the module 42 to the connector 40 into the I/O block assembly 38.

It will be understood that certain improvements and additions which would be obvious to one of ordinary skill in this art area have been deleted herein for the sake of conciseness and readability but all such are intended to fall within the scope of the following claims.

What is claimed is:

1. A method of blind connecting an I/O module into a cabinet having a wall section formed therein for proper sequential connection of first power and then signal inputs thereto comprising:

providing an opening in said wall section for loose mounting an electrical connector herein;

mounting an electrical connector having a pair of openings for accepting alignment members therein and stepped power and signal connectors into said wall opening;

providing an I/O module having a pair of alignment members protruding from the back thereof and having separate power and signal inputs in the area of said alignment members;

aligning said module alignment members with said openings of said connector;

partially pushing said module into said connector to allow the actuation of said power signals; and fully inserting said module into said connector to allow the application of said signal connections thereto when the power connection have been made.

2. A method of blind connecting an I/O module into a cabinet having a wall section formed therein for proper sequential connection of power and signal inputs thereto as set forth in claim 1 wherein the mounting of the connector includes the steps of inserting an ear section formed on one end of the connector by tilting the connector into the opening to place it under the wall section.

3. A method of blind connecting an I/O module into a cabinet having a wall section formed therein for proper sequential connection of power and signal inputs thereto as set forth in claim 1 wherein the mounting of the connector further includes the steps of pushing a flexible member formed on the end of the connector opposite the ear section into the opening to catch it under the wall section and provide a loose fit of the connector therein.

4. A method of blind connecting an electrical module into a wall section having a stepped electrical power and signal outlet for the sequential connection of first power and then signal inputs thereto comprising the steps of:

providing an opening in the wall section for loose mounting an electrical connector therein;

mounting an electrical connector having a pair of openings for accepting alignment members therein and stepped power and signal connectors into said wall opening;

providing a module having a pair of alignment members protruding from the back thereof and having separate power and signal inputs in the area of said alignment members;

aligning said module alignment members with said openings of said connector;

pushing said module into said connector to allow first the actuation of said power signals; and fully inserting said module into said connector to allow the application of said signal connections thereto once the power connections have already been made.

5. A method as set forth in claim 4 wherein the mounting of the connector includes the steps of inserting an ear section formed on one end of the connector by tilting the connector into the opening to place it under the wall section.

6. A method as set forth in claim 4 wherein the mounting of the connector further includes the steps of pushing a flexible member formed on the end of the connector opposite the ear section into the opening to catch it under the wall section and provide a loose fit of the connector therein.

* * * * *